US007926437B2

(12) United States Patent
Townsend

(10) Patent No.: US 7,926,437 B2
(45) Date of Patent: Apr. 19, 2011

(54) WATER SPORTS EQUIPMENT

(76) Inventor: Barnaby Alain Roger Townsend, London (GB)

( * ) Notice: Subject to any disclaimer, the term of this patent is extended or adjusted under 35 U.S.C. 154(b) by 0 days.

(21) Appl. No.: 12/162,106

(22) PCT Filed: Jan. 31, 2007

(86) PCT No.: PCT/GB2007/000320

§ 371 (c)(1),
(2), (4) Date: Apr. 1, 2009

(87) PCT Pub. No.: WO2007/088351

PCT Pub. Date: Aug. 9, 2007

(65) Prior Publication Data

US 2009/0221198 A1 Sep. 3, 2009

(30) Foreign Application Priority Data

Feb. 2, 2006 (GB) ..... 0602135.6

(51) Int. Cl.
*B63B 1/24* (2006.01)

(52) U.S. Cl. ..... 114/274; 441/68

(58) Field of Classification Search ..... 114/274; 441/68

See application file for complete search history.

(56) References Cited

U.S. PATENT DOCUMENTS

| | | | | |
|---|---|---|---|---|
| 2,815,518 | A * | 12/1957 | Kuehn | 441/65 |
| 3,077,850 | A * | 2/1963 | Beuby | 114/281 |
| 2001/0036780 | A1* | 11/2001 | Lorenzo | 441/68 |
| 2005/0266746 | A1* | 12/2005 | Murphy | 441/65 |

OTHER PUBLICATIONS

Airjunky, "2002 Tennessee Fly-In" (visited Dec. 8, 2010) <www.airjunky.com/tn2002> (other similar photo albums also available on this site).

Photograph from Airjunky, "2002 Tennessee Fly-In" <www.airjunky.com/tn2002/> showing man in black wetsuit on a blue board.

Photograph from Airjunky, "2002 Tennessee Fly-In" <www.airjunky.com/tn2002/> showing man in red wetsuit on a red board.

Photograph from Airjunky, "2002 Tennessee Fly-In" <www.airjunky.com/tn2002/> showing man on board and boat.

Photograph from Airjunky, "2002 Tennessee Fly-In" <www.airjunky.com/tn2002/> showing man in red wetsuit on a blue board.

* cited by examiner

*Primary Examiner* — Stephen Avila
(74) *Attorney, Agent, or Firm* — Modern Times Legal

(57) ABSTRACT

This invention relates to water sports equipment (10) for supporting a standing rider whilst the rider and the equipment are towed through the water, the equipment comprising: an elongate board (14) having an upper surface (16) carrying first (31, 33) and second (32, 34) foot securing means, said foot securing means being configured to be engaged by a respective foot of the rider so that the rider can stand on the board (14) with their body facing in a direction generally perpendicular to a direction in which the rider and equipment are towed through the water in use; a hydrofoil (11) having a longitudinal axis, said hydrofoil (11) being configured to impart lift to the board (14) when the rider and board are towed through the water; and means (12, 13) for affixing said hydrofoil (11) to said board (14) so that the hydrofoil is spaced from a lower surface (15) of the board and orientated such that said hydrofoil longitudinal axis is substantially transverse to the direction in which the rider and equipment are towed through the water in use.

20 Claims, 5 Drawing Sheets

WATER SPORTS EQUIPMENT

This invention relates to water sports equipment.

A variety of different water sports and associated water sports equipment have previously been proposed, and in some instances these sports have evolved into new and exciting sports requiring their own type of equipment.

For example, in a similar fashion to the way that snowboarding grew out of skiing, the sport of wakeboarding has evolved from the sport of water skiing. In wakeboarding, an individual sits or stands on a wakeboard (akin to a shortened surfboard) that is towed behind a powered water craft at speed.

Kitesurfing has evolved from the sport of wakeboarding, and uses a board which is almost identical to a wakeboard. However, in this instance a kite is used to harness the energy of the wind and power the board instead of a powered water craft. Kitesurfing is officially recognised as one of the fastest growing "extreme sports" in the world, and has gained popularity due to the fact that controlling the kite requires an entirely different type of skills to those used for traditional wakeboarding, and because the kitesurf board can be used in wave conditions that would be unsuitable for a powered water craft.

As a modification of existing water sports equipment, it has also previously been proposed to mount a hydrofoil underneath the equipment so that the board lifts out of the water, thereby reducing drag and enabling the board to travel at much higher speeds.

An example of such a proposal is disclosed in U.S. Pat. No. 5,249,998. The equipment described in this patent has become known colloquially as the "flying Ski" or "Air Chair", and comprises a board that is towed by a powered watercraft and to which a chair has been fitted. A rider sits in the chair over the board, and the board itself has an arm which extends downward from the board into the water and to which a hydrofoil has been fitted. As the board is towed through the water, the lift imparted by the hydrofoil causes the board to lift so that the rider "flies" over the surface of the water.

This arrangement has several performance advantages including the ability to travel at higher speeds resulting from reduced friction, and a better ability to turn. However, whilst the Air Chair has these advantages there are a number of key drawbacks which have hitherto limited its appeal to the market.

The first of these is that the air chair needs to be towed by a powered water craft, and hence the equipment cannot be used when weather conditions are unsuitable for powered water craft. As such conditions are usually when the most fun can be had with such a device, this is a serious limitation of its appeal as compared, for example, to a kitesurf board.

Another problem associated with the Air Chair is that the hydrofoil mounted beneath the board is a directional hydrofoil that imparts lift only when the water is flowing in one direction over the hydrofoil. The effect of this is that the air chair could not easily be used with a kite to avoid its reliance on powered water craft (and hence broaden the scope for its use) as the equipment cannot be used in a reverse direction without physically turning the board through 180 degrees in order to ride in the opposite direction.

Yet another problem is that the positioning of the hydrofoil towards one end of the board and the length of the arm which extends from the board to the hydrofoil mean that the forces on the ankles of a rider are so large that snowboard boots must be worn to give the rider sufficient ankle support. These boots tend to become heavy when waterlogged, and also pose a significant danger as they cannot be released quickly if the rider should have an accident.

Yet another problem associated with the Air Chair is that the length of the arm supporting the hydrofoil is such that a significant depth of water is required before the equipment can be used. However, many beaches have relatively shallow water which extends a long way out to sea, thereby preventing an easy launch of the device from that beach.

It is apparent, therefore, that it would be beneficial if water sports equipment could be provided that avoided or at least mitigated some or all of the problems associated with the Air Chair.

To this end, a presently preferred embodiment of the present invention provides water sports equipment for supporting a standing rider whilst the rider and the equipment are towed through the water, the equipment comprising: an elongate board having an upper surface carrying first and second foot securing means, said foot securing means being configured to be engaged by a respective foot of the rider so that the rider can stand on the board with their body facing in a direction generally perpendicular to a direction in which the rider and equipment are towed through the water in use; a hydrofoil having a longitudinal axis, said hydrofoil being configured to impart lift to the board when the rider and board are towed through the water; and means for affixing said hydrofoil to said board so that the hydrofoil is spaced from a lower surface of the board. In a particularly preferred arrangement, the means for affixing the hydrofoil to the board is configured so that said hydrofoil is orientated with said longitudinal axis substantially transverse to the direction in which the rider and equipment are towed through the water in use.

In a preferred embodiment, the hydrofoil comprises a bi-directional hydrofoil configured to impart lift to the board when the rider and board are towed, irrespective of the direction of water flow over the hydrofoil. This is advantageous as it allows the rider to avoid having to physically lift the board and turn it when they wish to change direction.

In a particularly preferred arrangement, the foot securing means are located on said upper surface in such a position relative to the hydrofoil that a rider can change the hydrofoil's angle of attack by moving their weight from one foot to the other. This provides for particularly easy and intuitive control of the board.

Preferably, the foot securing means are located to either side of and at least substantially equidistant from said hydrofoil.

In a preferred arrangement, said foot securing means are secured to said board in such a manner that the positions of said first and second foot securing means relative to said hydrofoil may be varied.

The hydrofoil may be detachable from said board. This allows for the equipment to be disassembled for storage and carriage. The hydrofoil may be affixed to said board by one or more frangible fasteners. The frangible fasteners may be configured to break and thereby release the hydrofoil from the board in the event of an impact between the hydrofoil and the sea bed or another submerged object.

The hydrofoil, board and said means for affixing the hydrofoil to the board are manufactured as a one-piece unit. This arrangement helps increase the strength of the equipment and hence reduces the likelihood of the equipment breaking.

In a preferred arrangement, the means for affixing the hydrofoil to the board comprises one or more struts.

The equipment may further comprise means operable when the equipment is ridden in an upwind direction to resist movement of the board in a downwind direction. This is advantageous as it resists the tendency of the board to be blown downwind.

In a preferred embodiment, the board comprises a heelside edge proximate heel portions of said foot securing means and a toeside edge proximate toe portions of said foot securing means, and said means for resisting downwind movement of the board comprises one or more struts having a hydrofoil shaped cross-section, the hydrofoil cross-section being configured to impart lift in a direction generally perpendicular to a direction of motion when the board is ridden with said heelside edge closer to the water than said toeside edge.

In another embodiment said means for resisting downwind movement of the board may comprise one or more generally planar fins mounted so as to be submerged in the water in use and so as to be generally perpendicular to said longitudinal axis of said hydrofoil.

Preferably the hydrofoil is wider than said board so that the hydrofoil projects beyond the periphery of the board. Respective ends of said hydrofoil may be inclined towards the lower surface of said board. The hydrofoil may be curved, V-shaped or any other shape suitable for lifting the board above the water. In a particularly preferred arrangement, the hydrofoil comprises a central section that is generally co-planar with said board lower surface, and first and second outer sections extending from respective ends of said central section, said first and second outer sections being inclined towards said lower surface of said board.

In one arrangement, the means for affixing said hydrofoil to the lower surface of said board is configured to orientate said hydrofoil so that said hydrofoil longitudinal axis is substantially perpendicular to the direction in which the rider and equipment are towed through the water in use.

In a preferred embodiment, the board comprises a toeside edge and a heelside edge, a first board end extending between first ends of said toeside and heelside edges and a second board end extending between second ends of said toeside and heelside edges, said first and second board ends being inclined away from said board upper surface and said hydrofoil. This arrangement assists early planing of the board and helps avoid nose-diving.

Preferably, the toeside edge and said heelside edge curve towards one another in the vicinity of said first and/or second ends.

Preferably, different regions of the board have different resistances to flexion. For example, a region of the board between said first and second foot securing means may have a greater resistance to flexion than regions of the board in the vicinity of either end.

In a second embodiment of the invention, the equipment further comprises: a second hydrofoil having a longitudinal axis, said second hydrofoil being configured to impart lift to the board when the rider and board are towed through the water; and means for affixing said second hydrofoil to said board so that the second hydrofoil is spaced from a lower surface of the board and orientated such that said hydrofoil longitudinal axis is substantially transverse to the direction in which the rider and equipment are towed through the water in use.

The first and second hydrofoils may be differently orientated with respect to the direction in which the rider and equipment are towed through the water in use. Alternatively, the first and second hydrofoils may be similarly orientated with respect to the direction in which the rider and equipment are towed through the water in use.

In a preferred embodiment, the equipment further comprises a grab handle fixedly attached to said upper surface of the board.

Other features and advantages of embodiments of the present invention will be apparent from the following detailed description of the present invention.

Various preferred embodiments of the present invention will now be described, by way of illustrative example, with reference to the accompanying drawings, in which.

FIGS. 9*a* to 9*d* illustrate yet further board designs.

Referring now to the figures, various presently preferred embodiments of the present invention will now be described with reference to the use of the equipment with a kite or a powered water craft. It will be appreciated, and should be noted, that the equipment is suitable for use with either form of power and hence that the following description is merely illustrative of the teachings of the present invention and not a limitation thereof.

Figure 1:
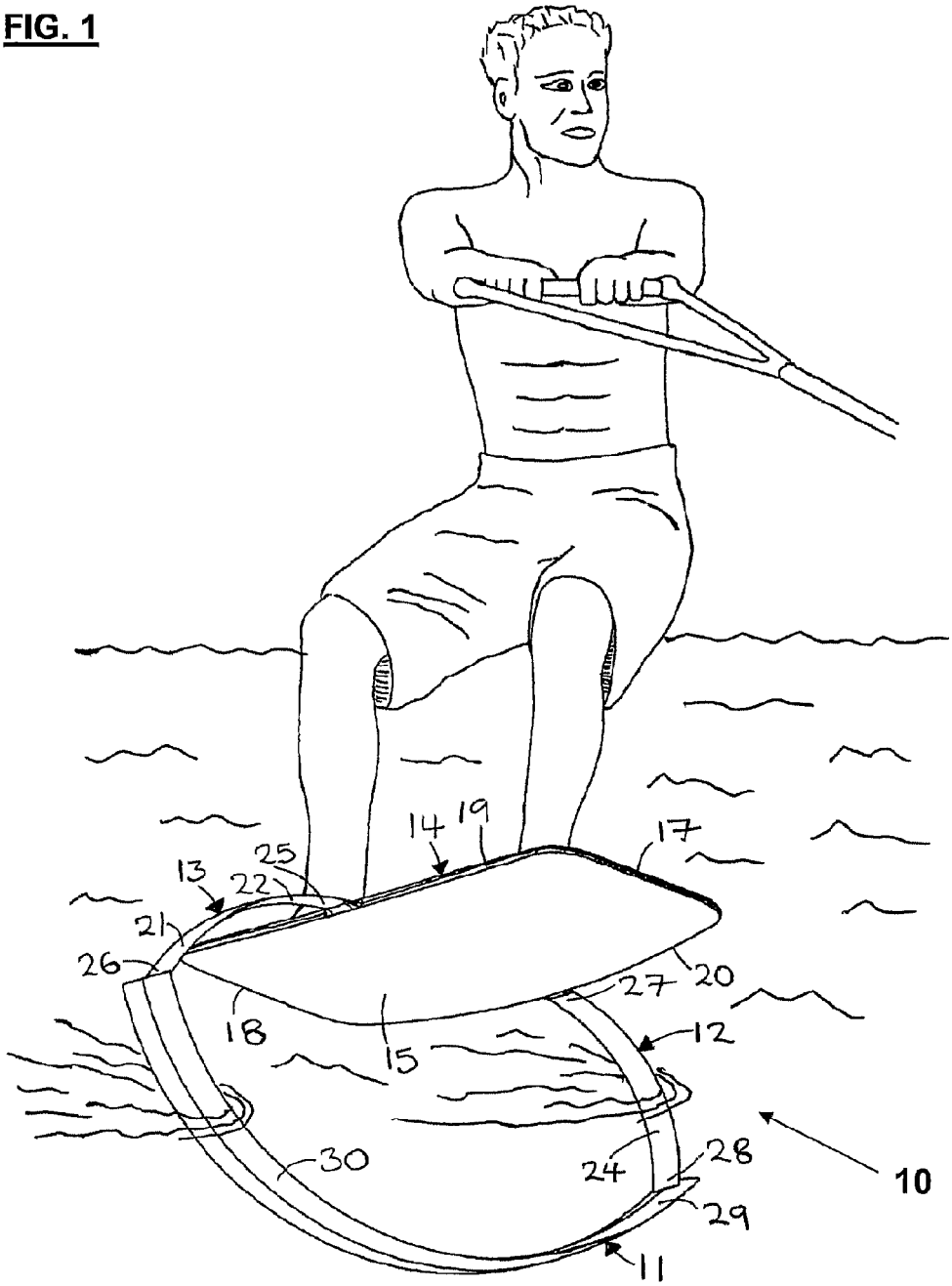
FIG. 1 is a perspective view of a rider standing on equipment according to a first embodiment of the invention, the equipment being towed behind a powered water craft (not shown)

As aforementioned, FIG. 1 is a perspective view of a rider standing on equipment according to a first embodiment of the invention, the equipment being towed behind a powered water craft (not shown) such as a speed boat. The equipment 10 (hereafter referred to a "hydrofoil board") comprises an elongate board 14 having a lower face 15 and an upper face 16. The board 14 has a left foot end 17, a right foot end 18, a toeside edge 19 and a heelside edge 20.

An elongate toeside strut 13 extends from the toeside edge 19, and comprises an upper face 21, a lower face 22, an inner end 25 and an outer end 26. An elongate heelside strut 12 extends from the heelside edge 20, and likewise comprises an upper face 23, a lower face 24, an inner end 27 and an outer end 28.

A hydrofoil blade 11 is secured between the toeside strut 13 outer end 26 and the heelside strut 12 outer end 28, and comprises an upper face 29 and a lower face 30. In a particularly preferred embodiment of the present invention the hydrofoil blade is a so-called bidirectional blade that is capable of generating a lift force irrespective of the direction of water travel over the upper and lower faces 29, 30. It should be noted however, that significant improvements can be provided with a unidirectional blade (i.e. a blade that is capable of generating a lift force only when water is traveling in a particular direction over the upper and lower faces 29, 30) and hence that the scope of the present invention is not limited solely to the provision of a bidirectional blade.

In this preferred embodiment, a left footpad 31 and right footpad 32 are secured to the upper face 16 of the board 14. A left footstrap 33 extends in a loop over the left footpad 31, and a right footstrap 34 extends in a loop over the right footpad 32 to thereby enable a rider to secure themselves to the board. The footstraps may, in a preferred embodiment, be adjustable. It is also preferable for a grab handle 35 to be secured to the upper face 16 of the board 14.

In the preferred arrangement, the footpads 31, 32 and footstraps 33, 34 are equidistant from and on either side of a toeside-heelside vertical axis of the equipment (line A-A in FIG. 2) that runs through the board 14, the struts 12, 13, and the hydrofoil 11. An advantage of this arrangement is that the rider can easily adjust the angle of attack of the hydrofoil blade 11 by shifting their weight, thereby controlling the lift generated by the hydrofoil 11. Whilst this arrangement is preferred, it should be noted that other arrangements are envisaged. For example, it may be desirable to have more weight on the rider's rear foot (for a given direction of travel) so that the board tends to leap more easily from the water thereby enabling the rider to put on a more spectacular display of his or her skills. For such an arrangement the rear footpad and footstrap would be further from the aforementioned axis than the other footpad and footstrap. In another envisaged arrangement, the position of the footpads and footstrap may be adjustable with respect to the aforementioned axis, and optionally with respect to their distance from the toeside or heelside edges of the board. This adjustment could be provided by providing the board with a series of mounting points for each footpad at differing positions on the board, or alternatively by mounting the footpads on runners secured to the upper face of the board.

As aforementioned, the hydrofoil board and rider can be towed by a powered water craft (such as a speed boat) using a standard wakeboard tow rope, the handle of which is held by the rider at arms length as illustrated in FIG. 1. Alternatively, the board and rider may be powered by a kite (typically known as a "power kite") of the type used for the sport of kitesurfing, the rider controlling the kite by means of a standard kite control system consisting of a bar and a waist harness which is worn by the rider.

Particular components of this embodiment of hydrofoil board 10 will now be described in greater detail. As is apparent from the top plan view of the board 10 shown in FIG. 3, in this embodiment the board 14 is symmetrical about both the aforementioned vertical central plane A-A (shown in FIG. 2) as well as an end to end vertical plane B-B (shown in FIG. 3).

In this preferred arrangement the toeside 19 and heelside 20 are each slightly curved so that they taper towards one another at both ends 17, 18 of the board. As aforementioned, in one preferred embodiment of the present invention the board is designed as a "twin-tip" board so that it is capable of being ridden in both directions. In such an arrangement the board has neither a front nor a back end, but for simplicity the ends have been labeled and will be referenced herein as a left foot end 17 and a right foot end 18.

Depending on rider preference, weight, and skill level the board 14 may have a variety of different lengths and widths. For example, a less experienced rider might opt for a longer board (because longer boards are more buoyant and easier to cause to plane) having a length of between 140 and 150 centimeters, and a width of around 38 to 45 centimeters; whereas a more experienced rider might opt for a shorter board. The exact dimensions most suitable for a given rider will also vary with the weight of the rider, with heavier riders tending towards longer and wider boards. Irrespective of the size of the board, it is also highly preferred, as is clearly visible from the side view shown in FIG. 2 for the ends 17, 18 of the board to curve upwards, as such an arrangement tends to help the board to ride over the water despite waves or other turbulence.

The board 14 can be constructed from wood, fibreglass, carbon fibre, foams (such as Corecell™ foam available from Structural Polymer Systems Limited (a subsidiary of Gurit-Heberlein AG), St. Cross Business Park, Newport, Isle of Wight, UK PO30 5WU), combinations of these materials, as well as many other materials and combinations of materials that will be immediately apparent to those persons skilled in the art of board building. The board may have a solid construction of one material or mixture of materials, or in another arrangement the board may have a monocoque structure with a hollow core. In another particularly preferred arrangement the board may have a laminar structure consisting of a sandwich of layers of material chosen for their particular properties. A variety of different manufacturing methods are available for achieving such a structure, and particularly good results have been obtained by sandwiching layers together in a vacuum bagging process. One particular advantage of a layered construction is that different regions of the board may have different properties. For example, the board may be constructed so as to be more flexible at the tips than in between the rider's feet, thereby improving the rider's ability to control the board.

In a particularly preferred arrangement, the footpads 31, 32 are made from softer materials than those used for the board construction so that the feet of the rider are cushioned in use. This is particularly advantageous when the rider and board leaps from the water as a not insignificant force may be exerted on the rider when the board hits the water once again, and resilient footpads help lessen the effect of this force on the rider.

The spacing between the footpads 31, 32 depends on rider preference and is usually set at around shoulder width, spaced symmetrically and equidistant from the toeside-heelside vertical central plane of the board 14. As aforementioned, however, other arrangements are envisaged within the scope of the teachings of the present invention.

The pads 31, 32 can either be formed as part of the upper face 16 of the board 14, or can be affixed to the upper face 16 after construction with a contact adhesive or similar. The footstraps 33, 34 may be made from a resilient relatively soft strap material and affixed to the board 14 by bolts which screw into threaded inserts in the upper face 16. Alternatively, the footstraps may be integrally formed with the footpads, and as aforementioned the footpads may be mounted on runners to the board to allow for the spacing of the pads with respect to the board to be adjusted.

In another preferred embodiment the footstraps and footpads may be replaced by resilient boots, for example of rubber, which are affixed (for example by bolts) to the upper face 16 of the board 14 or optionally to runners mounted to the board.

The struts 12, 13 extend from the edges 19, 20 of the board 14 in order to transmit the lift from the hydrofoil blade 11 to the board 14 and rider. They may be built into the body of the board 14, as an integral part of the structure in order to enhance the strength of the overall board. In another embodiment of the design they may be affixed at their inner ends 25, 27 to the board 14 with bolts or similar fastenings in a manner which allows them to be detached from the board 14, for example to facilitate transport of the device or to allow the board 14 to be ridden without the hydrofoil 11 and struts 12, 13 attached to it.

In a particularly preferred arrangement, the fixings used to mount the hydrofoil beneath the board may be configured to shear if a force (such as a force associated with a relatively high velocity impact of the hydrofoil with the sea bed or a submerged object) is applied to the hydrofoil in a direction generally perpendicular to one or other of the ends of the board. With such a configuration, in the event of an impact the fixings would shear and the hydrofoil and struts would separate from the board, thereby avoiding damage to the hydrofoil and reducing the chance of the rider being pitched forwards into the object that the board has collided with. For safety reasons with such an arrangement it is preferred for the struts to be mounted to the underside of the board, rather than for the struts to extend over the upper surface of the board (as they do in the embodiment of FIG. 7).

Figure 5:
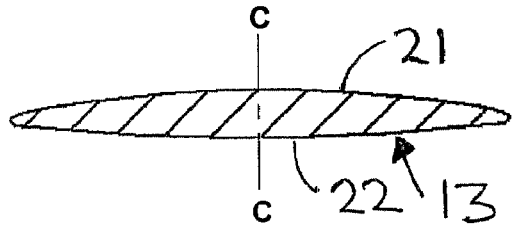
FIG. 5 is an enlarged sectional view along the line 5-5 shown in FIG. 4.

As shown in FIG. 5 the struts 12, 13 of this embodiment have a cross-section that is symmetrical about a vertical axis C-C; in order to allow the device to be ridden in both directions. As shown these struts 12, 13 have a hydrofoil (lift generating) cross-section that provides lateral lift in an upwind direction for use in kitesurfing when the board is ridden at a sharp angle with one of the edges 19, 20 lower than the other, at least partially submerging the strut 12, 13 associated with the lowermost edge. In this configuration, the lift generated by the hydrofoil shaped strut helps resist the tendency for the rider to be blown downwind.

In an alternative configuration, particularly suitable where the hydrofoil is provided with fins (as in the embodiment described in connection with FIG. 7), the strut may simply comprise a flat plate as the fins resist any tendency for the rider to be blown downwind.

Figure 6:
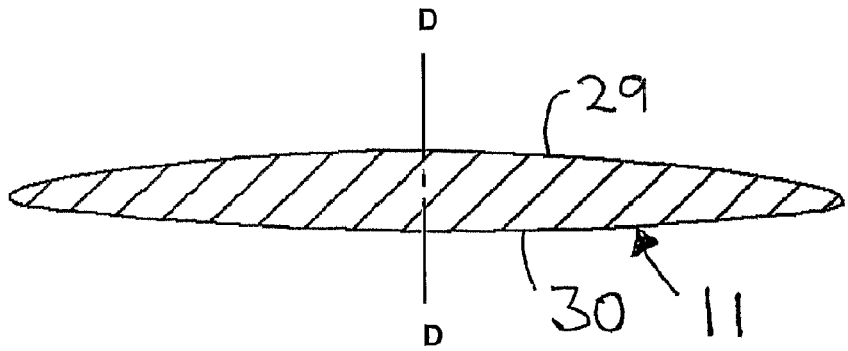
FIG. 6 is an enlarged sectional view along the line 6-6 shown in FIG. 4.

FIG. 6 illustrates the cross-sectional shape of the blade 11, and as shown the blade is preferably symmetrical about an axis D-D to thereby allow the hydrofoil to generate lift irrespective of the direction in which the board is ridden.

In the preferred arrangement, the hydrofoil blade 11 is permanently affixed at each end to the outer ends 26, 28 of the struts 12, 13 in order to increase the structural strength of the board. In an alternative arrangement, the blade 11 may be fixed (for example by bolts or other fixings) to the struts, thereby enabling the blade to be disassembled from the struts for easy transport of the equipment. As mentioned above, the fixings could be designed to shear and fracture in the event of an impact at speed that could otherwise damage the board.

The struts and hydrofoil may be of the same or similar construction to the board, or they may have a different construction to that used for the board. The struts and hydrofoil may be of any of a variety of different materials, for example they may be of carbon fibre or fibreglass. In another arrangement they may have a glass or foam core that is then covered with carbon fibre fibreglass. Other suitable materials will be immediately evident to persons of ordinary skill in the art.

Figure 7:
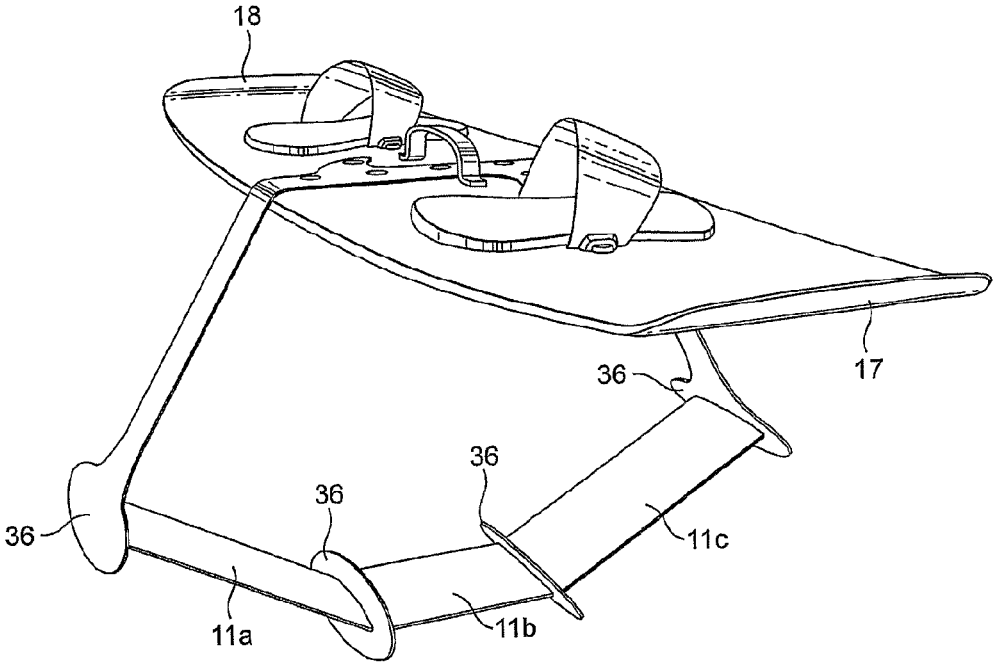
FIG. 7 is a perspective view of equipment according to a second embodiment of the present invention.

FIG. 7 is a schematic perspective view of a hydrofoil board according to a second embodiment of the invention.

In this arrangement the board 14 has enlarged tips 17, 18 that are significantly upturned away from the hydrofoil from the surface of the board. These tips, termed "flip tips", help avoid nosediving and help early planing of the board. In this embodiment, the hydrofoil 11 consists of three straight sections 11*a*, 11*b*, and 11*c* joined to one another (in the preferred arrangement by virtue of having been formed integrally with one another). The outermost sections 11*a* and 11*c* are inclined toward the board 14, whereas the central section 11*b* is generally co-planar with the underside of the board to yet further improve rider balance as compared to that which would otherwise be achievable with a V-shaped two-section hydrofoil.

The hydrofoil 11 of this embodiment further comprises a plurality of fins 36 orientated so as to be generally perpendicular to the hydrofoil. As aforementioned, the fins 36 function to resist any tendency for the rider to be blown downwind when travelling in an upwind direction. As this resistance is provided, in this embodiment, by fins the struts supporting the hydrofoil may comprise simple flat plates.

Figure 8:
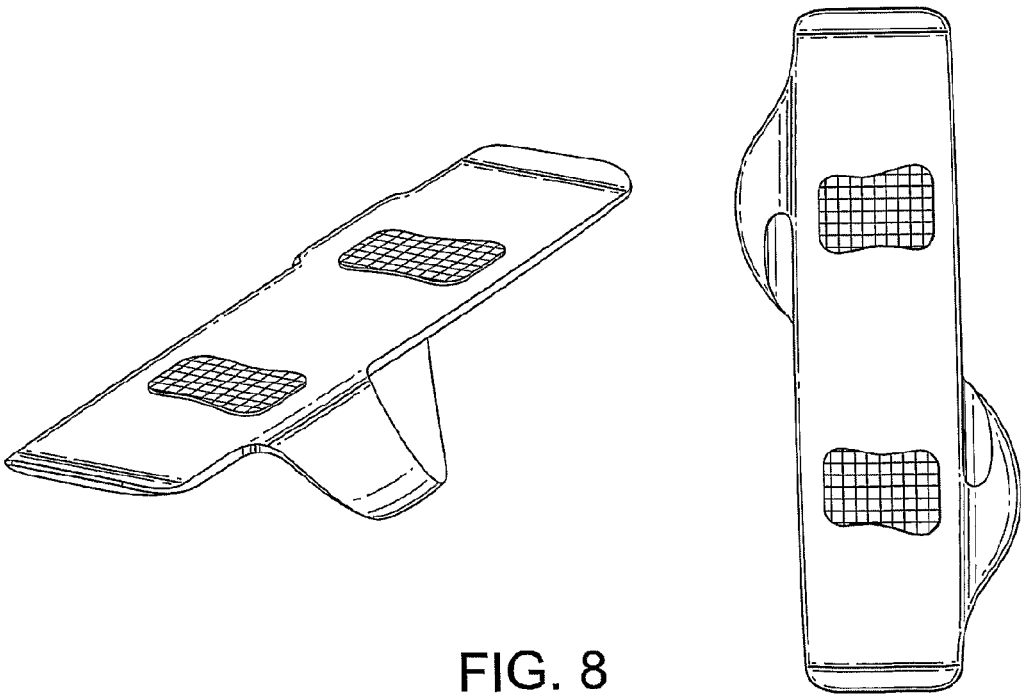
FIG. 8 shows two different views of a another board design.
Figure 9A:
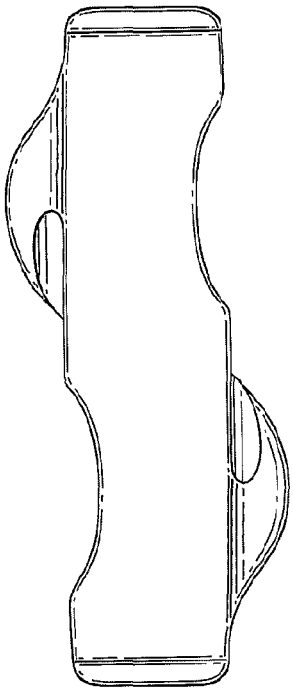
Figure 9B:
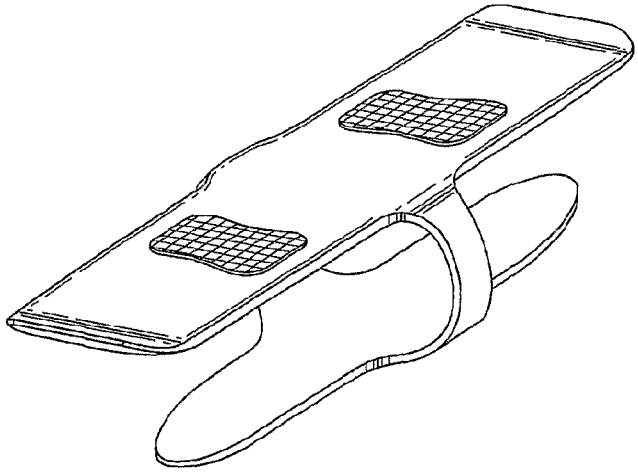
Figure 9C:
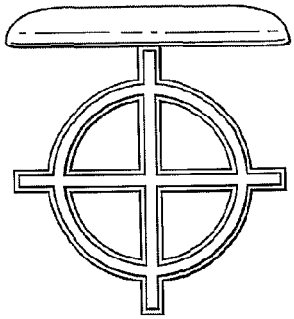
Figure 9D:
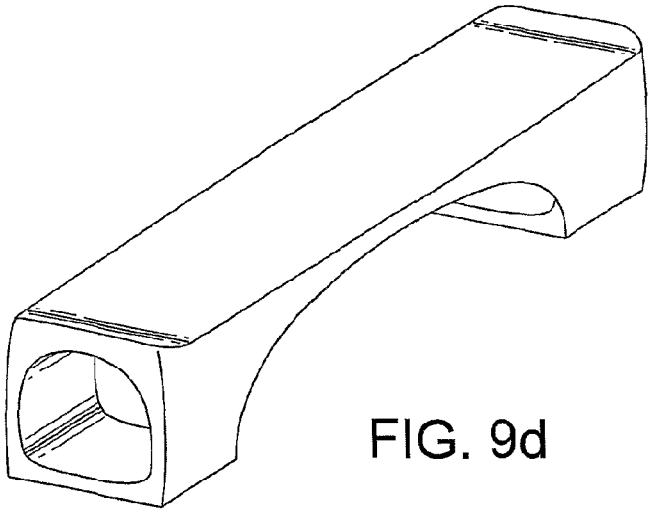

Referring now to FIGS. 8 and 9(*a*) to (*d*) of the drawings, there are shown a variety of different board designs, each of which has the advantages described herein. As will be appreciated from the selection of board designs shown in these figures, a further advantage of the teachings of the present invention is that the board designer has considerable freedom to design boards of quite different shape that all function as described herein. Specifically, in FIG. 8 the board has been designed with two hydrofoils and has a serpentine shape. Similarly, in FIG. 9*a*, the board is even more serpentine than that shown in FIG. 8. In FIG. 9*b*, the hydrofoil has a centre section that is extended towards each end of the board. In FIG. 9*c* the hydrofoil has a "+" shape, and in FIG. 9*d* the board has two hydrofoils each of which is configured as an open-ended box.

The operation of the hydrofoil board 10 and the significance of the structural relationships of the components of the hydrofoil board 10 will now be described.

Two different operational scenarios will hereafter be described for this equipment. In a first arrangement, the equipment is towed behind a power kite that harnesses the power of the wind. The rider launches the kite from the beach in the usual manner for kitesurfing, as approved by the International Kiteboarding Organisation (IKO). The rider would then pick up the hydrofoil board 10 by the grab handle 35 (or otherwise) and walk into the water to a depth greater than the maximum depth of the hydrofoil blade 11. The rider would then pilot the kite to a neutral position directly above them, then they must position their body on their back with the knees bent, and slide their feet into the foot straps 33, 34. The rider then swings the kite in the desired direction of travel, and allows the knees to flex further, putting more pressure on the front foot. The traction from the kite pulls the rider up onto the board and the board and rider will begin moving.

When moving at slow speeds with the board 14 generally horizontal the hydrofoil blade 11 will not be generating enough lift to raise the board 14 from the water, and the device can be ridden in the same manner as any normal kiteboard. An advantage over traditional kiteboards is that at this stage the submerged hydrofoil blade 11 and struts 12, 13 help to give the board directional stability, and to prevent it from being pulled off course downwind.

As aforementioned, in the preferred embodiment the central placement of the hydrofoil blade 11 and strut 12, 13 assembly in relation to the board easily allows the rider to change the angle of attack of the hydrofoil blade 11 by shifting their weight backwards or forwards relative to the blade 11. By increasing their speed, and inclining their weight backwards to increase the angle of attack of the hydrofoil blade 11, the rider is able to start using the hydrofoil blade 11 to generate lift which counteracts their own weight and lifts the board above the surface of the water so that the only portion of the hydrofoil board 10 in contact with the water is the hydrofoil blade 11 and the struts 12, 13. This ability of the rider to adjust the angle of attack of the hydrofoil is a significant advantage of the board disclosed herein.

The hydrofoil blade 11 illustrated in FIG. 1 is curved (when viewed from an end of the board), and this arrangement provides a surface piercing, self-stabilising hydrofoil which helps reduce the likelihood of the hydrofoil blade 11 jumping out of the water (known as "porpoising") when the speed is too great. This occurs because as the hydrofoil blade 11 generates lift and rises, so the outer edges are lifted above the surface of the water thereby reducing the total submerged lifting area of the blade. The lift generated is therefore reduced to a balance point at which the hydrofoil blade is no longer rising, and this becomes the cruising height.

Another key feature of the equipment described herein is that the geometry of the hydrofoil blade 11 and the struts 12, 13 (as illustrated in FIG. 1) aid the rider in travelling in an upwind direction. Specifically, when travelling upwind the rider will tend to be leaning backwards into the wind so as to avoid getting blown downwind, and the board 14 will therefore be at an angle, with the heelside edge 20 lower than the toeside edge 19. When the board is in this position the cross sectional shape (illustrated in FIG. 5) and the positioning and angle of the struts 12, 13 combine to generate a lateral lift force in the upwind direction while the board is ridden at an angle, and this lateral lift force helps the rider to more easily travel upwind.

The hydrofoil board 10 can be jumped using the same technique as with a normal kiteboard. This is achieved by braking sharply (by turning into the wind), and pulling the kite upwards in the sky to give lift. The upwind lift effect described in the previous paragraph allows the hydrofoil board 10 of the preferred embodiment to brake more sharply than existing products, thereby increasing the efficiency of the transfer of lift from the kite to the rider and the hydrofoil board 10. The end result of this is that higher jumps are possible with the board of the preferred embodiment.

Figure 2:
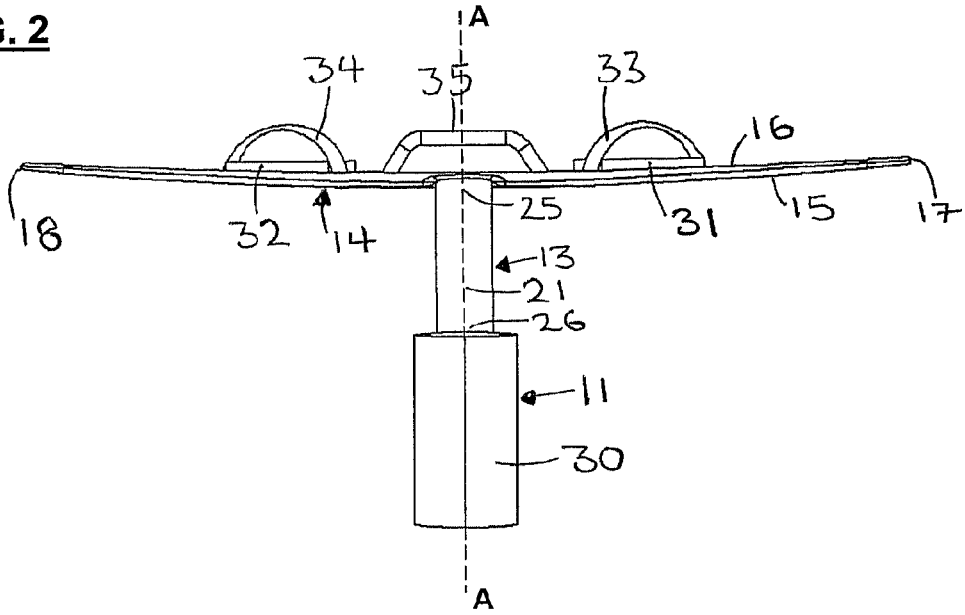
FIG. 2 is a side elevation of the water sports equipment of FIG. 1.
Figure 3:
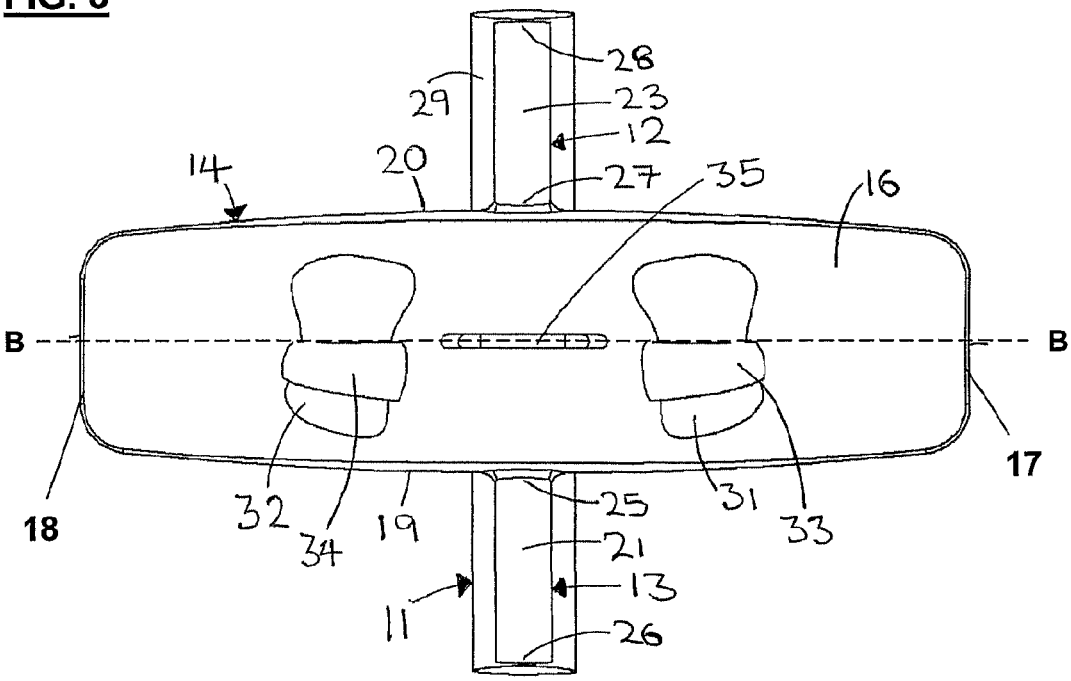
FIG. 3 is a top plan view of the water sports equipment of FIG. 1.
Figure 4:
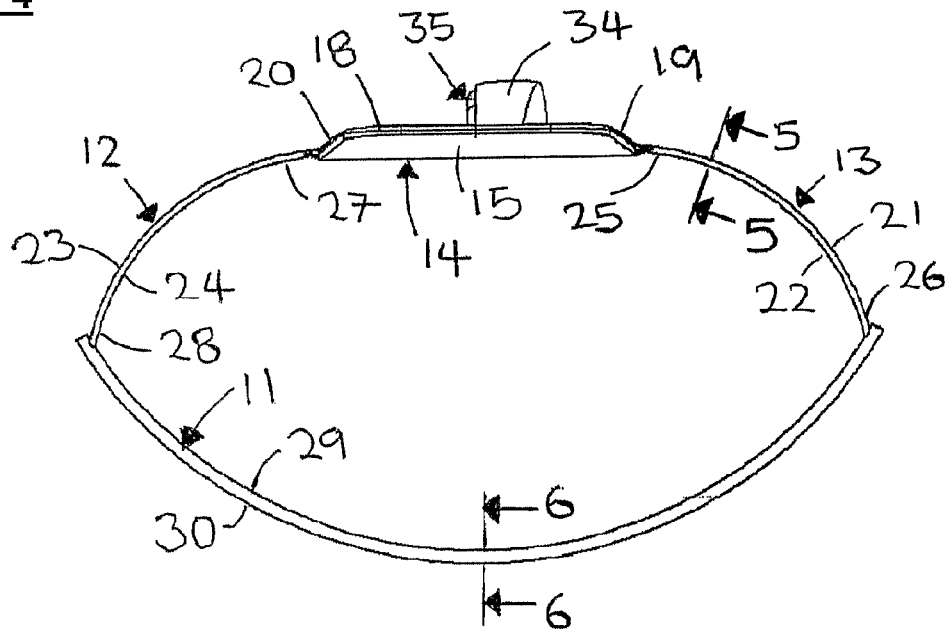
FIG. 4 is an end elevation of the water sports equipment of FIG. 1.

Landings for jumps are facilitated by the curvature of the lower face 15 of the board 14 (shown in FIG. 2 and known as the "rocker"). This allows for some correction is the landing angle of the board 14 if it is not fully aligned with the surface of the water.

The rider may also jump by shifting their weight backwards sharply to increase the angle of attack of the hydrofoil blade 11. This will lift it upwards sharply so that it will pop out of the water.

In order to turn and ride in the opposite direction across the wind, the rider performs the same manoeuvre as they would do with a standard twin-tip kiteboard. Firstly they must bring the kite above them to the neutral point, and turn the board 14 slightly towards the wind to act as a barrier to the direction of motion. They must then centralise their weight over the board to reduce the angle of attack of the hydrofoil blade 11 so that the board 14 sinks back to the water surface and begins to perform as a normal kiteboard. In doing this the rider will slow down and come to a stop. As soon as the rider feels the loss of speed, the rider pulls the kite downwards in the opposite direction to the previous one, and transfers their weight to the foot which was previously leading. The hydrofoil board 10 will then begin to move in the reverse direction without the need to be turned through 180 degrees.

As aforementioned, the equipment may also be towed behind a powered water craft. In such circumstances the equipment performs in exactly the same manner as previously described, and is ridden the same way. The difference is in the method of starting. Instead of operating a kite and harnessing the power from the wind, the rider is towed by a bar at the end of a rope from the watercraft. The starting body position in the water remains the same, with the bar held at arms length in the direction of the watercraft.

It will be apparent from the foregoing that the device described herein has significant performance improvements as compared to traditional boards.

It will also be apparent that whilst various embodiments of the present invention have been described herein, these embodiments are merely illustrative of the teachings of the invention and hence that modifications and alterations may be made thereto without departing from the scope of the invention. It should also be noted that the scope of the present invention extends to encompass any combination of features herein described irrespective of whether or not that particular combination has been claimed hereafter at this time.

As a modification of the particular arrangements described herein, the hydrofoil blade may instead be supported beneath the board by means of a single strut extending downwards from the board, preferably from the intersection of the aforementioned axes A-A and B-B. In other arrangements, the hydrofoil may be supported by more than two struts.

The equipment herein described may also be modified to include more than one hydrofoil blade. For example, two hydrofoil blades and associated strut assemblies may be affixed to the board 14, one blade being located roughly beneath each of the footpads 31, 32. Further blades could also be added.

Finally, whilst the board in FIG. 1 has a hydrofoil blade with a curved (generally circular) shape, this is not essential and the hydrofoil could instead have a V shape or comprise a blade that is mounted so as to be generally co-planar with the board. Many other shapes of hydrofoil that are suitable to impart lift to the board will be apparent to persons of ordinary skill in the art.

The invention claimed is:

1. Water sports equipment for supporting a standing rider whilst the rider and the equipment are towed through the water, the equipment comprising:

an elongate board having an upper surface carrying first and second foot securing members, said foot securing members being configured to be engaged by a respective foot of the rider so that the rider can stand on the board with their body facing in a direction generally perpendicular to a direction in which the rider and equipment are towed through the water in use;

a hydrofoil having a longitudinal axis, said hydrofoil being configured to impart lift to the board when the rider and board are towed through the water;

at least one mounting for affixing said hydrofoil to said board so that the hydrofoil is spaced from a lower surface of the board and orientated such that said hydrofoil longitudinal axis is substantially transverse to the direction in which the rider and equipment are towed through the water in use; and one or more movement resisting components that are operable when the equipment is ridden in an upwind direction to resist movement of the board in a downwind direction, wherein:

said board comprises a heelside edge proximate heel portions of said foot securing members and a toeside edge proximate toe portions of said foot securing members; and said one or more movement resisting components comprise one or more struts having a hydrofoil shaped cross-section, the hydrofoil cross-section being configured to impart lift in a direction generally perpendicular to a direction of motion when the board is ridden with said heelside edge closer to the water than said toeside edge.

2. Equipment according to claim 1, wherein said hydrofoil comprises a bi-directional hydrofoil configured to impart lift to the board when the rider and board are towed, irrespective of the direction of water flow over the hydrofoil.

3. Equipment according to claim 1, wherein said foot securing members are located on said upper surface in such a position relative to the hydrofoil that a rider can change the hydrofoil's angle of attack by moving their weight from one foot to the other.

4. Equipment according to claim 3, wherein said foot securing members are located to either side of and at least substantially equidistant from said hydrofoil.

5. Equipment according to claim 1, wherein said foot securing members are secured to said board in such a manner that the positions of said first and second foot securing members relative to said hydrofoil may be varied.

6. Equipment according to claim 1, wherein said hydrofoil is detachable from said board.

7. Equipment according to claim 6, wherein said hydrofoil is affixed to said board by one or more frangible fasteners.

8. Equipment according to claim 7, wherein said frangible fasteners are configured to break and thereby release the hydrofoil from the board in the event of an impact between the hydrofoil and the sea bed or another submerged object.

9. Equipment according to claim 1, wherein said hydrofoil, board and said at least one mounting for affixing the hydrofoil to the board are manufactured as a one-piece unit.

10. Equipment according to claim 1, wherein said at least one mounting for affixing the hydrofoil to the board comprises one or more struts.

11. Equipment according to claim 1, wherein said at least one mounting for affixing said hydrofoil to the lower surface of said board is configured to orientate said hydrofoil so that said hydrofoil longitudinal axis is substantially perpendicular to the direction in which the rider and equipment are towed through the water in use.

12. Equipment according to claim 1, wherein the board comprises a toeside edge and a heelside edge, a first board end extending between first ends of said toeside and heelside edges and a second board end extending between second ends of said toeside and heelside edges, said first and second board ends being inclined away from said board upper surface and said hydrofoil.

13. Equipment according to claim 12, wherein said toeside edge and said heelside edge curve towards one another in the vicinity of said first and/or second ends.

14. Equipment according to claim 1, wherein different regions of the board have different resistances to flexion.

15. Equipment according to claim 14, wherein a region of the board between said first and second foot securing means has a greater resistance to flexion than regions of the board in the vicinity of either end.

16. Equipment according to claim 1, further comprising:

a second hydrofoil having a longitudinal axis, said second hydrofoil being configured to impart lift to the board when the rider and board are towed through the water; and at least one mounting for affixing said second hydrofoil to said board so that the second hydrofoil is spaced from a lower surface of the board and orientated such that said hydrofoil longitudinal axis is substantially transverse to the direction in which the rider and equipment are towed through the water in use.

17. Equipment according to claim 16, wherein said first and second hydrofoils have a relative configuration selected from: the first and second hydrofoils are differently orientated with respect to the direction in which the rider and equipment are towed through the water in use, and the first and second hydrofoils are similarly orientated with respect to the direction in which the rider and equipment are towed through the water in use.

18. A method for a rider to be towed through water using water sports equipment, the water sports equipment comprising:

an elongate board having an upper surface carrying first and second foot securing members, said board also having a heelside edge proximate heel portions of said foot securing members and a toeside edge proximate toe portions of said foot securing members;

a hydrofoil having a longitudinal axis, said hydrofoil being affixed to the board and spaced from a lower surface of the board; and one or more movement resisting components that are operable when the board is ridden in an upwind direction to resist movement of the board in a downwind direction, said one or more movement resisting components comprising one or more struts having a hydrofoil shaped cross-section, the hydrofoil cross-section being configured to impart lift in a direction generally perpendicular to a direction of motion when the board is ridden with said heelside edge closer to the water than said toeside edge;

the method comprising:

the rider standing on the board with each of the rider's two feet located in the foot securing members; and the rider remaining upright with a coupling between a body part of the rider and a tow secured to a source of locomotion that tows the rider and the board across the water, the hydrofoil being orientated such that said hydrofoil longitudinal axis is substantially transverse to the direction in which the rider and the board are towed through the water, and the hydrofoil imparting lift to the rider and the board while towed.

19. Water sports equipment for supporting a standing rider whilst the rider and the equipment are towed through the water, the equipment comprising:

an elongate board having an upper surface carrying first and second foot securing members, said foot securing members being configured to be engaged by a respective foot of the rider so that the rider can stand on the board with their body facing in a direction generally perpendicular to a direction in which the rider and equipment are towed through the water in use;

a hydrofoil having a longitudinal axis, said hydrofoil being configured to impart lift to the board when the rider and board are towed through the water;

at least one mounting for affixing said hydrofoil to said board so that the hydrofoil is spaced from a lower surface of the board and orientated such that said hydrofoil longitudinal axis is substantially transverse to the direction in which the rider and equipment are towed through the water in use; and one or more movement resisting components that are operable when the equipment is ridden in an upwind direction to resist movement of the board in a downwind direction, said one or more movement resisting components comprising one or more generally planar fins mounted so as to be submerged in the water in use and so as to be generally perpendicular to said longitudinal axis of said hydrofoil.

20. Water sports equipment for supporting a standing rider whilst the rider and the equipment are towed through the water, the equipment comprising:

an elongate board having an upper surface carrying first and second foot securing members, said foot securing members being configured to be engaged by a respective foot of the rider so that the rider can stand on the board with their body facing in a direction generally perpendicular to a direction in which the rider and equipment are towed through the water in use;

a hydrofoil having a longitudinal axis, said hydrofoil being configured to impart lift to the board when the rider and board are towed through the water; and at least one mounting for affixing said hydrofoil to said board so that the hydrofoil is spaced from a lower surface of the board and orientated such that said hydrofoil longitudinal axis is substantially transverse to the direction in which the rider and equipment are towed through the water in use, wherein:

said foot securing members are located on the upper surface of the board in such a position relative to the hydrofoil that a rider can change the hydrofoil's angle of attack by moving their weight from one foot to the other; and said foot securing members are located to either side of and at least substantially equidistant from said hydrofoil.

* * * * *